US007878363B2

(12) United States Patent
Nilsson

(10) Patent No.: US 7,878,363 B2
(45) Date of Patent: Feb. 1, 2011

(54) CUBICAL BEVERAGE PACKAGING UNIT

(75) Inventor: Erik Nilsson, Stockholm (SE)

(73) Assignee: Cubis Limited, Nicosia (CY)

( * ) Notice: Subject to any disclaimer, the term of this patent is extended or adjusted under 35 U.S.C. 154(b) by 655 days.

(21) Appl. No.: 10/587,378

(22) PCT Filed: Feb. 2, 2005

(86) PCT No.: PCT/SE2005/000127

§ 371 (c)(1),
(2), (4) Date: Apr. 30, 2007

(87) PCT Pub. No.: WO2005/075303

PCT Pub. Date: Aug. 18, 2005

(65) Prior Publication Data

US 2007/0241118 A1 Oct. 18, 2007

(30) Foreign Application Priority Data

Feb. 4, 2004 (SE) ..... 0400217

(51) Int. Cl.
*A47G 19/22* (2006.01)
*B65D 85/62* (2006.01)

(52) U.S. Cl. ..... 220/709; 220/708; 220/705; 206/501; 206/503; 206/504; 206/508

(58) Field of Classification Search ..... 220/709, 220/708, 705, 212, 293, 288; 215/389, 388, 215/229, 228, 329; 206/501, 503, 504, 508; 222/143, 129
See application file for complete search history.

(56) References Cited

U.S. PATENT DOCUMENTS 2,643,789 A * 6/1953 Theobald, Sr. ..... 220/522
3,874,554 A * 4/1975 Chang ..... 220/708
4,251,019 A * 2/1981 Cone ..... 229/103.1
5,052,614 A * 10/1991 Xuan ..... 229/103.1

(Continued)

FOREIGN PATENT DOCUMENTS

WO WO 85/04850 A1 11/1985

*Primary Examiner*—Anthony Stashick
*Assistant Examiner*—Kareen Rush
(74) *Attorney, Agent, or Firm*—Alfred J. Mangels

(57) ABSTRACT

A beverage packaging unit (1) that includes an opening (8) from which the liquid contents of the unit can be drunk, wherewith said opening, or orifice (8), can be closed with the aid of an closure element (3). The invention is characterized in that the packaging unit (1) is parallelepipedic in shape including a hollow box-like body (2) and said closer element (3); in that said parallelepipedic hollow box-like body (2) has a bevelled corner at which there is formed a three-sided or triangular surface (7) that connects with said box-like body; in that there projects out from said surface (7) a tubular part (4) that includes said opening or orifice; in that said closure element (3) includes a generally pyamidal body which is shaped so that when in abutment with said bevelled corner of said box-like body (2) it forms, together with said body, said parallelepipedic packaging unit (1); in that said closure element includes a cavity (6) for receiving said tubular part (4); and in that the packaging unit includes co-acting fasteners (10) on said tubular part (4) and also in said cavity (6) for removably retaining said closure element (3) at said tubular part, so that said box-like body (2) and said closure element (3) will form a parallelepiped.

10 Claims, 3 Drawing Sheets

U.S. PATENT DOCUMENTS 5,188,283 A * 2/1993 Gu ..... 229/103.1
5,348,217 A * 9/1994 Bettle et al. ..... 229/103.1
5,489,026 A * 2/1996 D'Aloia ..... 206/570
5,518,143 A * 5/1996 Iodice ..... 220/708
5,782,358 A 7/1998 Walker ..... 206/509
6,056,149 A * 5/2000 Murphy et al. ..... 220/705
6,129,265 A * 10/2000 Perryman et al. ..... 229/103.1
6,206,278 B1 * 3/2001 Cornell et al. ..... 229/103.1

* cited by examiner

CUBICAL BEVERAGE PACKAGING UNIT

BACKGROUND OF THE INVENTION

1. Field of the Invention

The present invention relates to a beverage packaging unit.

2. Description of the Related Art

In present day society people drink a large number of different sorts of beverages, for instance aerated or carbonated beverages, juices, milk, milk-based beverages, and also packaged beer, ale, and wine, for instance in portion-wise packaging units.

The most common packaging units for present day beverages are bottles of varying sizes each with its characteristic appearance, i.e., a cylindrical package that narrows at its top to form an orifice from which the beverage can be drunk. The orifice can be re-sealed with the aid of a screw-threaded cork or a screw cap. The bottles are normally made of plastic, such as PET, or glass.

Another type of common packaging unit is an aluminum can of cylindrical shape, so as to enable such cans to be mutually stacked, and including a characteristic can opening procedure in which part of the aluminum end in the form of a tab is broken away from the upper end of the can to provide an opening from which the contents of the package can be drunk.

Another common type of packaging unit is a Tetra Pak® unit with which a plastic wrapped drinking straw is glued to one of the two largest side surfaces of the Tetra Pak unit. The contents of that packaging unit are typically drunk by removing the straw from the unit and then removing the plastic wrapping and inserting the straw down through a hole provided in the upper side of the Tetra Pak® packaging unit and that is covered with aluminum foil. The contents of the Tetra Pak® unit can then be drunk through the straw.

Another common beverage packaging unit is a glass bottle that includes a cap fitted over the neck orifice of the bottle, and an opening from which the bottle contents can be drunk.

All types of packaging units have certain positive and negative aspects. Generally speaking, some packaging units are not transport effective because they cannot be packed tightly together, while others cannot be re-sealed, and because some other packaging units are unhygienic. The drawbacks are described in more detail hereinafter.

One problem with respect to some packaging units is that they are transported over long distances, most often in large freight vehicles. The shape of cylindrical beverage packaging units prevents optimal use of the freight volume of the vehicle. The typical PET bottles are usually placed in crates, which are then stacked firmly one upon the other. That means that large volumes around the bottles and above and beneath respective bottles go unused. That problem thus also exists with all cylindrical packaging units that have a tapering upper part, where either a screw cork or a screw cap is affixed. Another packaging unit that constitutes a part of this problem is the typical aluminum can, which is also cylindrical and therefore also results in unused freight volume around the cans.

Another problem with many beverage packaging units is that they can not be re-sealed. When such a packaging unit has been opened on a given occasion in order to drink its contents, it is normally either necessary for the person concerned to empty the unit of its contents at one and the same time or to throw away beverage that he/she does not wish to drink subsequent to having opened the unit.

The person drinking from a packaging unit will normally wish to drink a small amount, often at different times, and be able to re-seal the unit so that its remaining contents can be drunk later on. One solution to that problem is a bottle that is sealed with a screw-on cork, for instance a PET-bottle, although those bottles have less effective freight-volume properties, as mentioned above. Other typical beverage packaging units, such as aluminum cans, glass bottles provided with caps, or Tetra Pak® packaging units, cannot be re-sealed.

The unhygienic packaging unit presents a further problem. Aluminum cans are exposed to the surroundings from the manufacture and then during transportation, e.g., to the grocery store, and then within the store itself, and subsequently, until the liquid in respective cans has been drunk. In order to drink from the can, the can is opened and the part of the can that is folded away to provide an opening through which the contents of the can be drunk is folded down into the can, i.e., down into the liquid that is later to be drunk. Some packaging units, among them aluminum cans, are designed so that the person drinking from the unit is forced to place his/her mouth directly against a part of the packaging unit which, as earlier mentioned, has been exposed to the surroundings from the manufacture of the can until the person concerned drinks from the unit. Moreover, the liquid is drunk from the can into which the can part that has been folded away to provide the opening has been immersed. The person who drinks the liquid in the can is thereby exposed to bacteria, virus, and/or toxic substances, for instance, as a result of the direct contact of the person's mouth with both the can and the liquid, which is unhygienic.

One further drawback and problem encountered with the Tetra Pak® packaging unit that includes a drinking straw is that the Tetra Pak® unit is deformable. Consequently, when the unit has been opened with the aid of the straw, and while gripping the Tetra Pak® unit with unaccustomed fingers the unit is squeezed together to such an extent that liquid will gush from the Tetra Pak unit like a fountain and therewith land outside the unit.

All of the above-described problems associated with known beverage packaging technology are solved by means of the present invention, which provides a stackable and re-sealable and hygienic beverage packaging unit.

SUMMARY OF THE INVENTION

In accordance with the present invention there is provided a beverage packaging unit that includes an opening from which the liquid contents of the unit can be drunk or poured. The opening, or orifice, can be closed with the aid of a closure element. The packaging unit is parallelepipedal in shape and includes a hollow, box-like body and the closure element. The parallelepipedal, hollow, box-like body has a bevelled corner at which there is formed a three-sided, or triangular, surface that is connected with the box-like body. Projecting outwardly from the triangular surface is a tubular part that includes the opening or orifice. The closure element includes a generally pyramidal body that is shaped so that when in abutment with the bevelled corner of the box-like body it forms, together with the body, the parallelepipedal packaging unit. The closure element includes a cavity for receiving the tubular part. The packaging unit includes co-acting fasteners on the tubular part and also in the cavity for removably retaining the closure element at the tubular part, so that the box-like body and the closure element form a parallelepiped.

BRIEF DESCRIPTION OF THE DRAWINGS

The invention will now be described in more detail, partly with reference to an exemplifying embodiment of the invention illustrated in the accompanying drawings, in which.

DESCRIPTION OF THE PREFERRED EMBODIMENTS

Figure 1A:
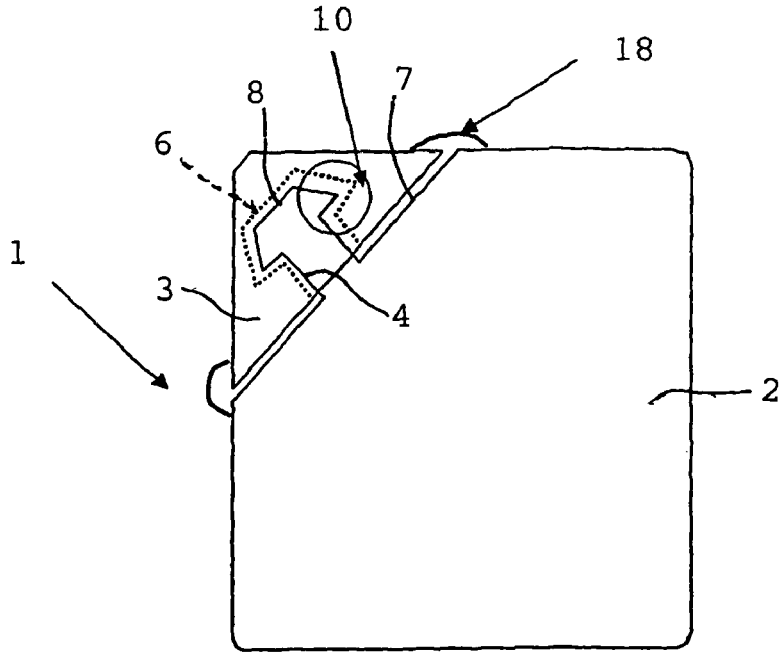
FIG. 1A shows a side view of a packaging unit in accordance with the invention, in which an outwardly projecting tubular part is placed on a three-sided surface of a box-like body to provide an opening from which liquid beverage can be dispensed, and also shows the opening closure part of the packaging unit in abutment with the three-sided surface of the box-like body.
Figure 1B:
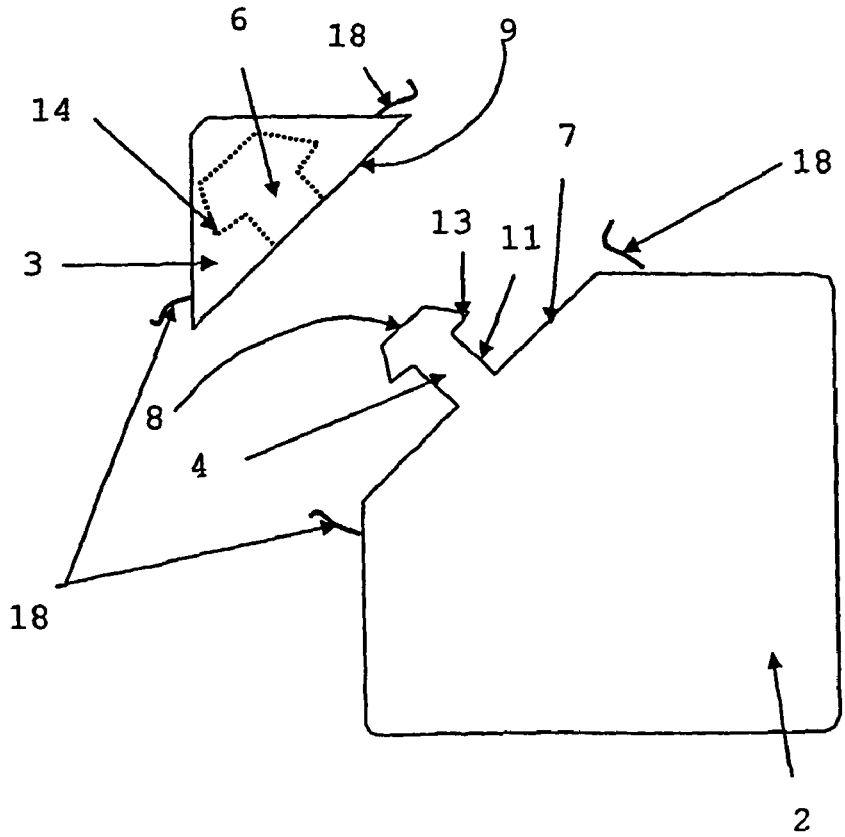
FIG. 1B is an exploded side view of the packaging unit shown in FIG. 1A with the closure part of the packaging unit released from the outwardly projecting tubular part of the box-like body.

FIGS. 1A and 1B show a beverage packaging unit 1 in accordance with the present invention that includes a parallelepipedal, hollow, box-like body 2, and an opening closure element 3. An opening 8 is provided through which a beverage contained in the body 2 can be drunk. The opening 8 is sealable with the aid of closure element 3.

The packaging unit 1 is parallelepipedal in shape and includes the hollow box-like body 2 and the opening closure element 3. One of the corners of the parallelepipedal hollow body 2 is bevelled to provide a three-sided or triangular surface 7 that is connected with the box-like body 2. An outwardly projecting tubular part 4, which includes opening 8, is located on the triangular surface 7.

The opening closure element 3 includes a generally pyramidal body that is so configured that when the opening closure element 3 is in abutment with the triangular surface 7 at the bevelled corner of the box-like body 2, the pyramidal body will form the parallelepipedal beverage packaging unit 1 together with the box-like body 2. The opening closure element 3 includes a cavity 6 for receiving the tubular part 4. Mutually co-acting fastening means 10, for instance snap fasteners or screw threads, are provided on both the tubular part 4 and in the cavity 6. The co-acting fastening means releasably retain the opening closure element 3 on the tubular part 4, so that the box-like body 2 and the opening closure element 3 will form the parallelepipedal packaging unit 1.

In accordance with one embodiment of the invention there is included tubular part 4 and opening 8 through which beverage contained in the box-like body 2 is dispensed.

FIGS. 2A-2D illustrate a further embodiment in which a tube 5, such as a drinking straw, made of an appropriate plastic material, is firmly fixed relative to box-like body 2. The straw preferably is an expandable or non-expandable straw that extends through the tubular part 4 down into the interior of the box-like body 2, with the bottom end 20 of the straw in contact with the bottom 21 of the box-like body 2.

The tube 5 inserted down into tubular part 4 is expandable along a portion extending from tubular part 4. The tube 5 preferably includes an outwardly-extending edge 16 positioned to come into abutment with the inside surface 17 of the body 2 to prevent displacement of the tube 5 from its position within the box-like body. The edge 16 is resiliently deformable to the extent that the edge 16 will deflect when the tube is pressed down through the tubular part 4. Subsequent to the tube 5 and the edge 16 having been forced down into the box-like body 2, the edge 16 will return to its original form and serve as an obstacle to withdrawal of the tube 5 from the box-like body 2, or to outward movement of the tube 5 away from the bottom 21 of box-like body 2.

In accordance with one embodiment, the tube 5 lacks the edge 16, thereby enabling the tube 5 to be freely withdrawn from the box-like body 2 and, likewise, enabling the tube 5 to be freely inserted into the body.

In one embodiment of the invention, with the tubular part 4 including the opening, the fastening means 10 is a snap-in fastener. As shown in FIG. 1B, the snap-in fastener preferably includes an outwardly-extending shoulder or lip 13 located externally on the tubular part 4, and a shoulder-receiving recess 14 located inside the cavity 6 of the closure element 3. The fastening means 10 is adapted so that the closure element 3 can be rotated relative to the tubular part 4. The closure element 3 is removed from the tubular part 4, preferably by twisting the element 3 so that the corners of the element are free from the triangular surface 7. The closure element 3 is then withdrawn orthogonally from shoulder or lip 13 and away from the triangular surface 7 of the body 2. As the opening closure element 3 is powerfully withdrawn, preferably by one and the same person, the shoulder 13 and the shoulder-receiving recess 14 are finally deformed elastically and the closure element 3 is thus released from the box-like body 2. The packaging unit can be re-sealed, because the shoulder 13 and the recess 14 remain intact after removal of the closure element 3, thereby enabling the packaging unit to be re-closed by virtue of the shoulder 13 snapping into the shoulder-receiving recess 14.

In another embodiment of the invention, the fastening means 10 is screw-threaded, wherein the tubular part 4 includes an external screw thread. The cavity 6 of the closure element 3 includes internal threads. The closure element 3 is released from the box-like body 2, by turning the closure element 3 in a given direction so that the element 3 will loosen from the box-like body 2.

Figure 2A:
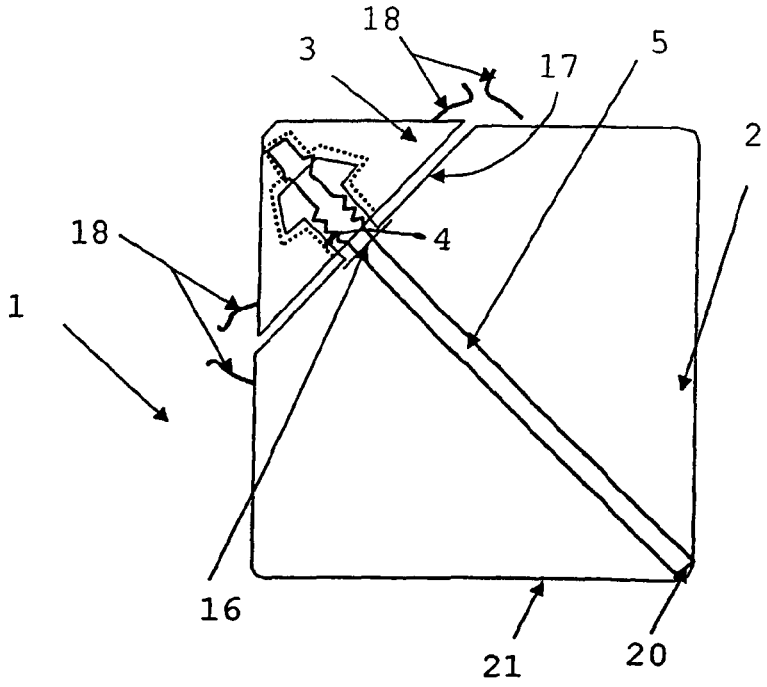
FIG. 2A is a side view of the packaging unit shown in FIGS. 1A-1B including a tube or drinking straw inserted in the outwardly projecting tubular part and showing the closure element in abutment with the three-sided surface of the box-like body.
Figure 2B:
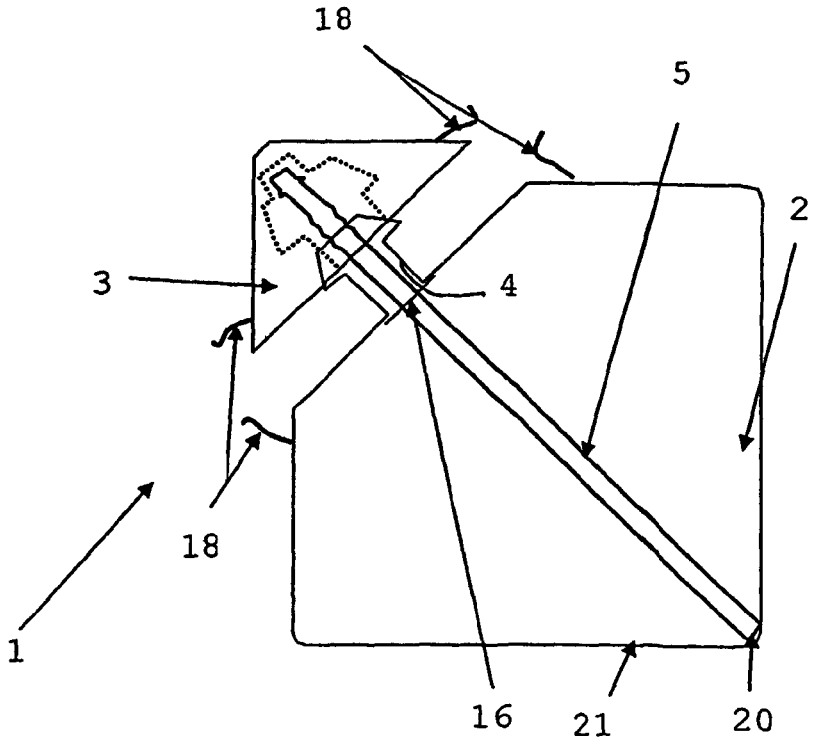
FIG. 2B is an exploded side view of the packaging unit shown in FIG. 2A with the closure element shown loosened from the outwardly projecting tubular part of the box-like body but still in contact with the pipe or straw.
Figure 2C:
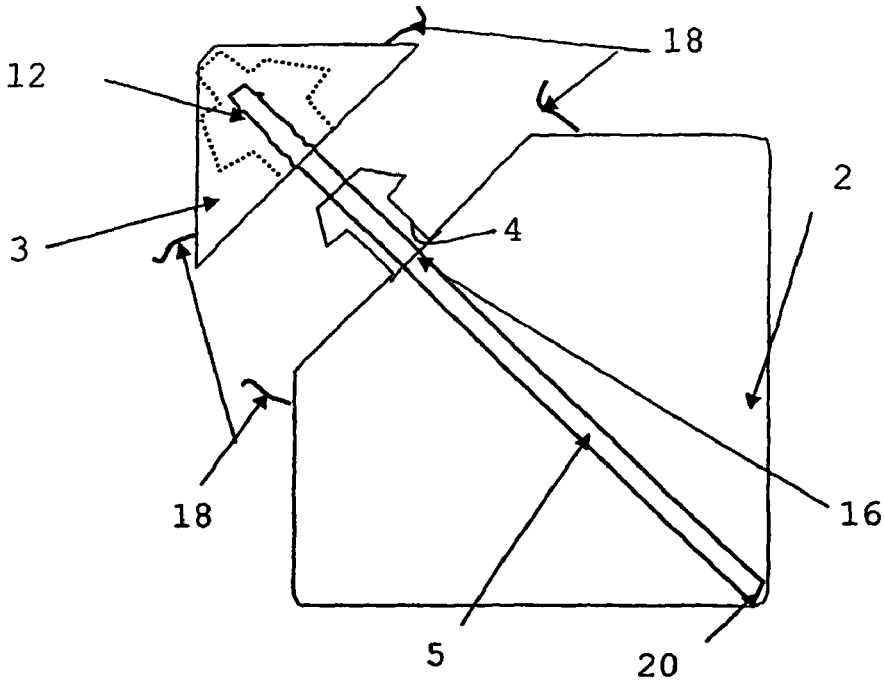
FIG. 2C is an exploded side view of the packaging unit shown in FIGS. 1A and 1B with the opening closure element fully released from the outwardly projecting tubular part and from the pipe or straw inserted in the tubular part.
Figure 2D:
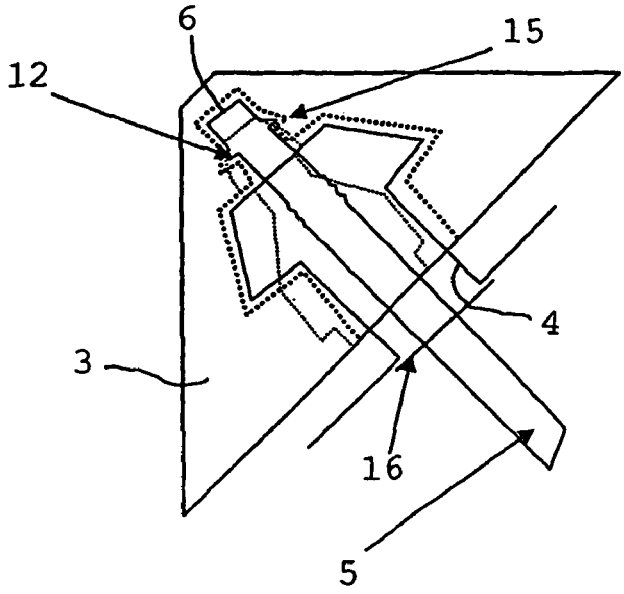
FIG. 2D is an enlarged, fragmentary side view of the opening closure element shown in FIG. 2C, including the cavity, the straw, and the outwardly projecting tubular part.

In a further embodiment the tube 5 is placed in the tubular part 4 in which a snap-lock is provided (see FIG. 2D). The snap-lock is in the form of an outer toothed ring 12, which preferably encircles the tube 5, and a recess or notch 15 in the cavity 6 of the closure element 3. The recess 15 also preferably encircles the cavity 6, so that the toothed ring 12 and the recess 15 hook together because of the resilient deformation of the ring 12 and the recess 15. Because the ring 12 and the recess 15 remain intact and are not permanently deformed, the packaging unit can be re-closed by virtue of the recess 15 snapping onto the toothed ring 12. The ring 12 and the recess 15 are used so that the tube 5 is able to expand.

The tubular part 4 is preferably enlarged at a distance outward from the triangular surface 7, so that the person concerned will be able to encircle the tubular part 4 with his/her lips and therewith drink from the packaging unit 1. That arrangement avoids lip contact with surfaces of the box-like body 2 that have not been protected by the closure element 3.

The opening closure element 3 is capable of sealing abutment with the triangular surface 7 of the box-like body 2 in the case of all embodiments, and preferably also with the outer end of the tubular part 4. That arrangement also protects the triangular surface 7 and the tubular part 4 from contamination.

Plastic bridges 18 are preferably fastened between the box-like body 2 and the closure element 3 that abuts said body 2, irrespective of the embodiment concerned. When removing the closure element 3 from the box-like body 2 and thereby opening the packaging unit 1, the plastic bridges 18 are severed, thereby indicating that the packaging unit has been opened.

Although a number of embodiments have been described above, it will be understood that the outwardly projecting tubular part 4 of the box-like body 2, the tube 5, and the cavity 6 of the closure element 3 can be designed in some other appropriate manner without departing from the basic concept of the invention.

The present invention shall therefore not be considered to be limited to the described and illustrated exemplifying embodiments thereof, since variations can be made within the scope of the accompanying claims.

The invention claimed is:

1. A beverage packaging unit that includes an opening through which the beverage can be drunk, said beverage packaging unit comprising: a parallelepipedal packaging unit including a hollow box-like body having opposed, planar and parallel top and bottom walls, a pair of opposed planar and parallel front and rear walls, and a pair of opposed planar and parallel sidewalls, wherein the front and rear walls and the sidewalls each extend between and are perpendicular to the top and bottom walls, a closure element for overlying a dispensing opening in the box-like body, wherein one upper corner of the hollow box-like body is bevelled to form a planar triangular surface at the one upper corner of the box-like body; a tubular part that extends from the triangular surface and which includes the dispensing opening; the closure element including a generally pyramidal body having a triangular base with three edges and having triangular sides that extend from respective ones of the edges of the triangular base to form the pyramidal body, whereby the closure element is configured so that respective ones of the triangular sides of the closure element are coplanar with respective adjacent sidewalls and the top wall of the packaging unit when the closure element overlies the tubular part and overlies the dispensing opening and when the triangular base of the closure element is in surface-to-surface abutment with the bevelled corner of the box-like body, whereby the closure element forms together with the box-like body a stackable parallelepipedal packaging unit defined by planar and parallel front and rear walls, planar and parallel side walls, and planar and parallel top and bottom walls so that when stacked vertically one packaging unit upon another packaging unit the bottom wall of an upper packaging unit rests stably on and is in surface-to-surface contact with the top wall of a lower packaging unit; wherein the closure element includes a cavity for receiving the tubular part of the box-like body; and wherein the packaging unit includes mutually co-acting fastener means on the tubular part and within the closure element cavity, wherein the fastener means serves to removably retain the closure element on the tubular part so that when the closure element is connected to the packaging unit and is in overlying relationship with the planar triangular surface of the upper corner bevel of the box-like body, the box-like body and the closure element together form a parallelepiped defined by respective rectangular outer walls.

2. A beverage packaging unit according to claim 1, wherein the closure element is rotatable relative to the tubular part.

3. A beverage packaging unit according to claim 1, including a tube that extends through the tubular part and down into the interior of the box-like body for beverage dispensing.

4. A beverage packaging unit according to claim 1, including a tube that extends through the tubular part down to a bottom of the box-like body.

5. A beverage packaging unit according to claim 3, wherein the tube is expandable at a location spaced outwardly from the tubular part.

6. A beverage packaging unit according to claim 1, wherein the fastener means includes a snap-lock connection.

7. A beverage packaging unit according to claim 1, wherein the fastener means includes screw threads.

8. A beverage packaging unit according to claim 3, wherein an outer end of the tube includes a snap lock that co-acts with the closure element to serve as a connection therebetween.

9. A beverage packaging unit according to claim 1, wherein the tubular part extends outwardly sufficiently from the triangular surface for a person to place his/her lips around the tubular part and thereby drink from the box-like body.

10. A beverage packaging unit according to claim 1, wherein the closure element is in sealing abutment with an outer end of the tubular part and with the triangular surface.

* * * * *